US006543662B1

(12) United States Patent
Kuhlmann et al.

(10) Patent No.: US 6,543,662 B1
(45) Date of Patent: Apr. 8, 2003

(54) WEB TRANSPORT SYSTEM

(75) Inventors: Heinz Kuhlmann, Stadtbredimus (LU); Eckehard Fiedler, Vaals (NL)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/719,904

(22) PCT Filed: Jun. 15, 1999

(86) PCT No.: PCT/EP99/04116

§ 371 (c)(1),
(2), (4) Date: Mar. 12, 2001

(87) PCT Pub. No.: WO99/65807

PCT Pub. Date: Dec. 23, 1999

(30) Foreign Application Priority Data

Jun. 17, 1998 (EP) ..... 98401481

(51) Int. Cl.[7] ..... B65H 23/24; B65H 29/24

(52) U.S. Cl. ..... 226/97.3; 242/615.11; 271/195

(58) Field of Search ..... 226/97.3; 271/195; 242/615.11

(56) References Cited

U.S. PATENT DOCUMENTS 2,848,820 A * 8/1958 Wallin et al. ..... 226/97.3
3,070,901 A * 1/1963 Allander et al. ..... 226/97.3
3,232,507 A * 2/1966 Petersson et al. ..... 226/97.3
3,705,676 A * 12/1972 Overly et al. ..... 226/97.3
4,074,841 A * 2/1978 Kramer et al. ..... 226/97.3
4,698,914 A * 10/1987 Shu et al. ..... 226/97.3
5,016,363 A * 5/1991 Krieger
5,209,387 A * 5/1993 Long et al. ..... 226/97.3
5,317,817 A * 6/1994 Roberts et al. ..... 226/196.1

FOREIGN PATENT DOCUMENTS

DE 1 951 002 * 4/1971
DE 1 951 345 * 4/1971
DE 43 34 473 * 4/1995
FR 2.057.832 * 5/1971

* cited by examiner

*Primary Examiner*—Michael R. Mansen

(57) ABSTRACT

A method and apparatus for transporting a web having at least one table element including at least one inclined blowing device (4*a*–4*d*), at least one rounded hump (8), and at least one sucking device (6*a*–6*c*) between the at least one blowing device (4*a*–4*d*) and the at least one rounded hump (8). The rounded hump (8) allows the sucking of air without any risk of tearing or breaking the web (3). The limited amount of air ensures high transport forces, and increased efficiency of the transport system.

24 Claims, 3 Drawing Sheets

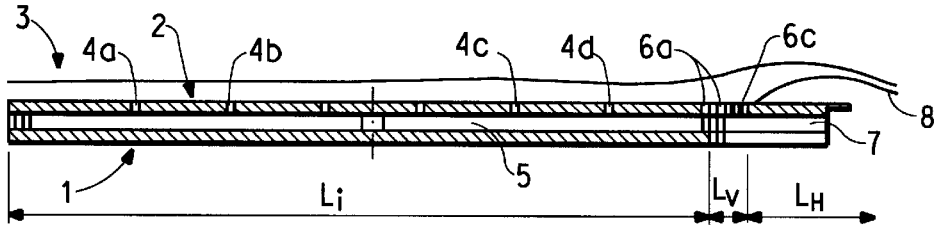
FIG. 1
FIG. 2
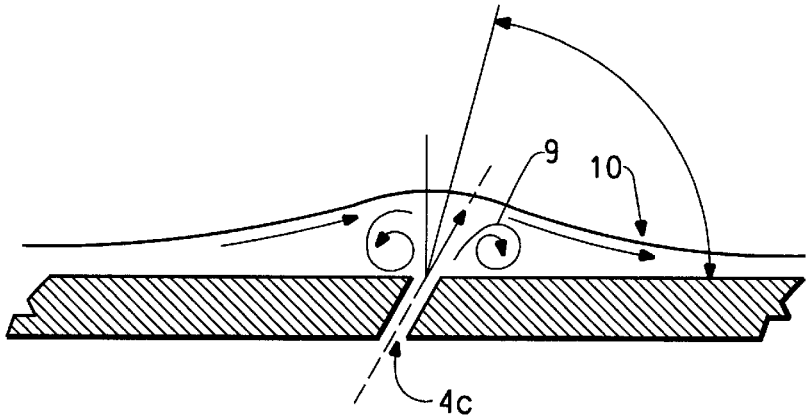
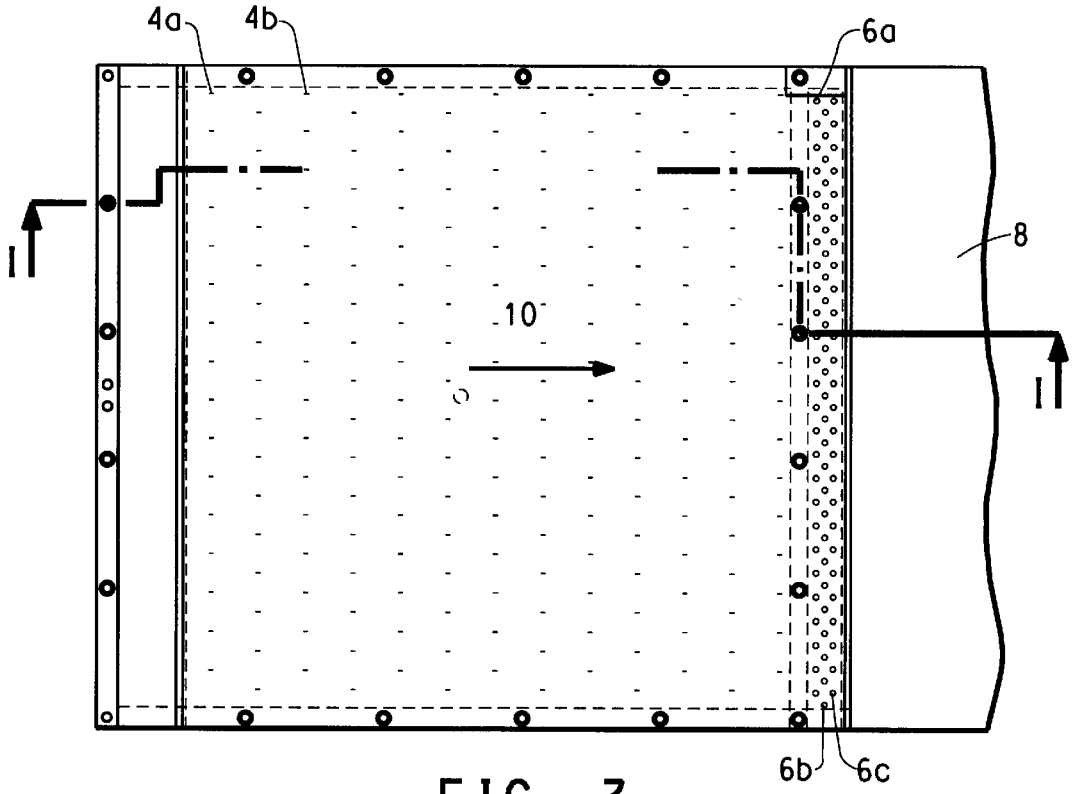
FIG. 3

FIG. 5
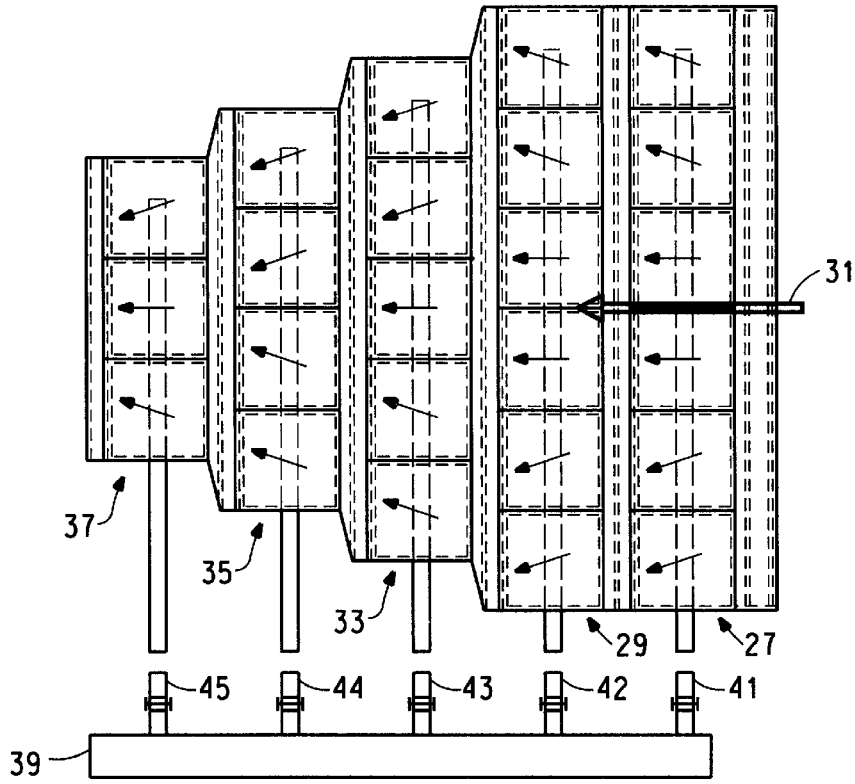
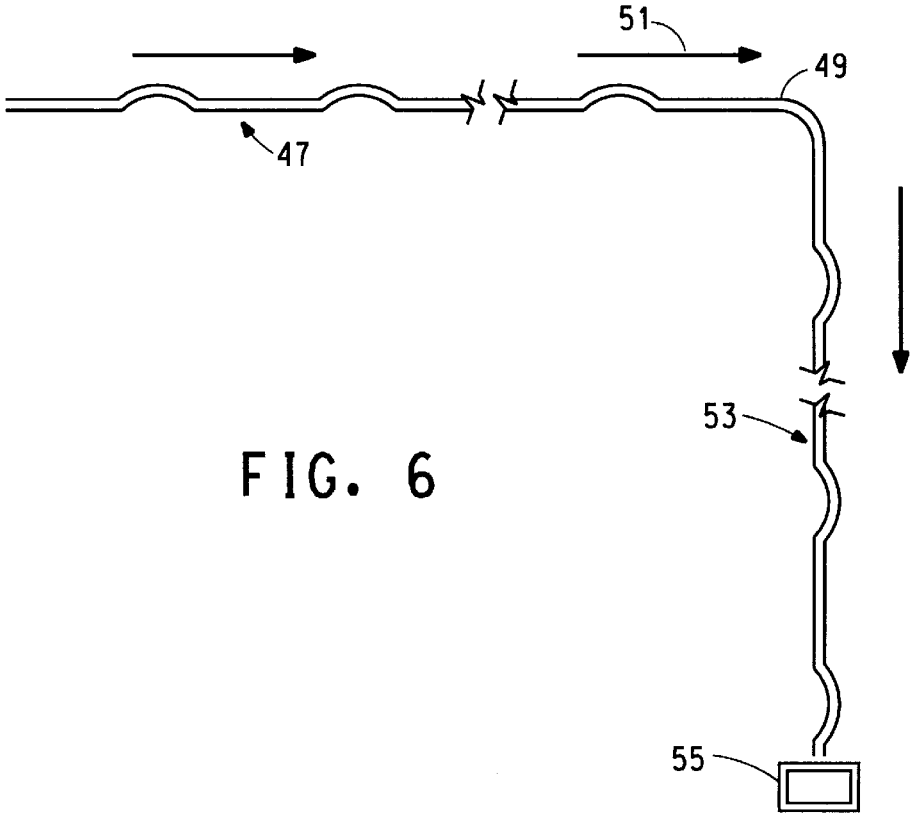
FIG. 6

WEB TRANSPORT SYSTEM

BACKGROUND OF THE INVENTION

The present invention relates to transport systems for webs, such as webs of PET, PEN, their copolymers and other polymers. It applies more generally to all kinds of plastic webs, laminated or coextruded plastic webs, paper webs, metallic webs such as aluminum webs, woven or non-woven webs.

Systems for transporting webs are needed, e.g. at the exit of tenter ovens or coating systems, or even inside of an oven, or for bringing the webs to the winding stations. State of the art web transport system comprise Coanda systems, where a flow of air is injected at the upstream edge of the table, parallel to the surface of the table. The web is sucked and transported downstream on the table, by this flow of air. Such systems have the following disadvantages. First, they only operate properly on a relatively short distance. Indeed, after a certain distance, the web tends to take off, flutters and does not follow the table. Second, these systems only operate on the whole width of a web, and not on pieces or parts of web. Third, they require high air volumes and only allow to obtain low forces (around 1 $N/m^2$) and relatively low pressures.

State of the art systems also comprise Coanda systems for transporting a web along the circumference of a roll. These systems operate like the Coanda systems described above, the flat surface of the table being replaced by the cylindrical surface of the roll. These systems are subject to the same disadvantages.

There exist Coanda systems where the air is blown from holes distributed on the table; such systems are for instance sold by Hein & Lehmann, of Krefeld, Germany. The speed of air in such systems is around three times the speed of the web, while the pressure lies around 2000 Pa. The ratio of the size of the holes to the size of the active surface area lies above 9%. The flow is parallel to the table. These systems are not very efficient as they are involving a high volume of air and create an important noise because the air is hitting sharp edges..

In addition, these prior art transport systems are not appropriate for transporting ultra thin webs, e.g. submicron webs. At such thicknesses, the web has only little or no mechanical strength, so that prior art solutions cannot be used; fluttering of the web leads to high mechanical stresses to the web, and can destroy the web.

Accordingly, there exists a need for web transport systems that may provide higher forces distributed over the web, transport webs over long distances, using low air volumes, emitting minimum noise. There also exists a need for a transport system that may accommodate various widths of web, different web thickness in the range from submicron webs 1 to 36 $\mu$m webs. Such a transport system should also be able to transport not only complete webs, but scrap pieces; transport speed may be as high as 500 m/min or even higher; such a system should ensure a stable transport in any given direction, and should also provide self-alignment ability. The system will operate on a flat surface (table), and also for transportation along a tube with a circular cross-section or with another cross section, e. g. a polygonal cross section. More generally, it should operate to transport webs on any surface which is essentially continuous along the transport direction.

The invention provides a solution to the above mentioned problems of the prior art; it provides a transport system having all the advantages and features listed above.

BRIEF SUMMARY OF THE INVENTION

According to the invention, there is provided a table element for transporting a web, comprising:

at least one inclined blowing means;

at least one protruding hump;

at least one sucking means located between said blowing means and said protruding hump.

In a preferred embodiment, said protruding hump ensures that a web is lifted away from the table element upstream of the protruding hump. Preferably, the shape of the protruding hump ensures a partial blocking of the air blown by the blowing means, upstream of the hump.

The shape of the protruding hump may also ensure acceleration of the air flowing over the hump, downstream of the hump.

In one embodiment of the invention, said blowing means comprise lines of offset holes. The sucking means may also comprise lines of offset holes.

In another embodiment, the angle between a blowing direction of said blowing means and a direction perpendicular to the table element is comprised between 10° and 90°, and is preferably around 30°.

It is possible that the projection on said table of a blowing direction of said blowing means forms an angle with the transport direction.

In one embodiment, the speed of the air blown by the blowing means is at least 8 times the contemplated speed of the web, preferably 10 to 15 times the speed of the web.

Preferably, the ratio of the area of the blowing means to the area of the section of the table containing the blowing means is less than 1%, preferably less than 0.5%.

Advantageously, the sucking means are located upstream of the hump, in the section where the hump cause the web to be raised.

It is possible that the protruding hump is a rounded hump. In another embodiment, the rounded hump has a circular cross section with a diameter at least eight times the thickness of the air layer between the table and the web to be transported.

The invention also relates to a transport system comprising at least one of such table element. In one embodiment, the transport system may comprise at least two series of table elements, spaced apart in a direction transverse to the transport direction. The series of transport table elements are then preferably adapted to be moved one toward or away from the other.

In one embodiment, the table elements on each side of the transport system have blowing means the blowing direction of which is directed towards the side of the transport system.

One may also provide means for pumping air to the blowing means, and from the sucking means, the ratio between the flow of air the flow of air from the sucking means and the flow of air to the blowing means being comprised between 0.5 and 1, and to preferably being around 0.7.

The invention also relates to a process for transporting webs on the surface of a table having at least one rounded hump, comprising the steps of (a) blowing air upstream of the said at least one hump, through the table;

(b) sucking air immediately upstream of the rounded hump.

Preferably, the step of blowing air comprises blowing air in a direction inclined with respect to the surface of the table.

The invention relates to a web transport system, where a web is transported by a flow of air along the surface of a table, characterised by a hump with a shape ensuring a partial blocking of air flowing onto it.

The shape of the protruding hump will ensure acceleration of the air flowing over the hump, downstream of the hump.

The invention finally relates to a web transport system, where a web is transported by a flow of air along the surface of a table element, characterised in that the air is blown by blowing means distributed over the surface of table, at a speed at least 8 times the contemplated speed of the web, preferably 10 to 15 times the speed of the web.

Advantageously, the angle between a blowing direction of said blowing means and a direction perpendicular to the table element is comprised between 10° and 90°, and is preferably around 30°.

In one embodiment, the projection on said table of a blowing direction of said blowing means forms an angle with the transport direction.

In another embodiment, the ratio of the area of the blowing means to the area of the section of the table containing the blowing means is less than 1%, preferably less than 0.5%.

BRIEF DESCRIPTION OF THE SEVERAL VIEWS OF THE DRAWINGS

A transport system embodying the invention will now be described, by way of non-limiting example, with reference to the accompanying drawings, in which:

FIG. 1 is a schematic view showing a cross section of a part of a transport system according to the invention;

FIG. 2 is a schematic view in cross section of one blowing opening of the transport system of FIG. 1;

FIG. 3 is a schematic top view of the part of FIG. 1;

FIG. 5 is a top view of another transport system according to the invention;

FIG. 6 is a view in cross section of a transport system according to the invention, for use at the exit of an oven.

DETAILED DESCRIPTION OF THE INVENTION

Figure 4:
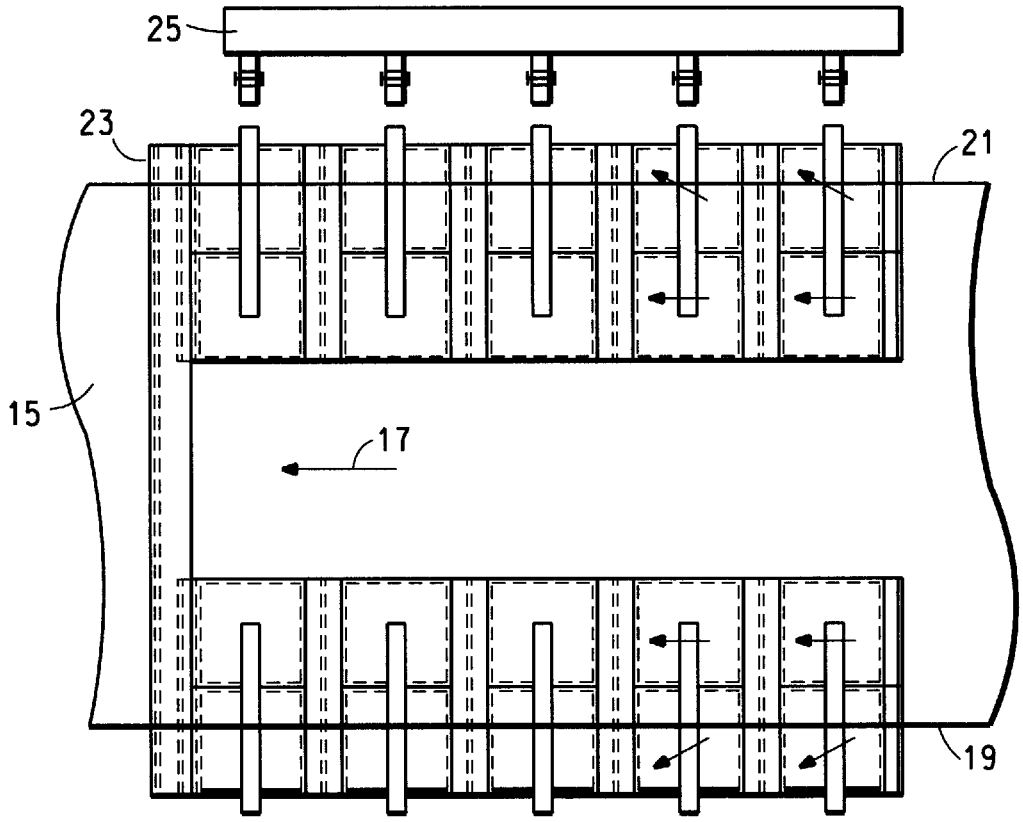
FIG. 4 is a top view of a transport system.

The invention is described in the preferred embodiment in relation to a flat transport table. It is not limited to such a flat table, and the invention may equally well be carried out on a cylindrical or prismatic surface having any possible cross section. Such a surface is actually a rounded or prismatic table.

FIG. 1 is a schematic view in a vertical section of a part of a transport system according to the invention, along the transport direction; the transport system of FIG. 1 comprises a table 1, on the surface 2 of which a web 3 may be transported. The table comprises a series of blowing means such as openings or slots 4*a*–4*d*, through which air or another gas may be blown from an air pressure box or cabinet 5, located under the blowing means; for blowing air, it is possible to use fans or other types of air displacement means, that are not depicted in the figures. The static pressure in the air pressure box is comprised between 0.01 bar and 0.5 bar (1,000 Pa to 50,000 Pa) above the atmospheric pressure. The blowing means 4*a*–4*d* are inclined with respect to the direction normal to the surface of the table, so that the flow of air is blown at least partly along the transport direction of the web. The blowing means ensure a smooth and efficient transportation of the web along the table, and provide tension in the web; the multiple impulse on the web, due to the series of blowing means, allows the amount of air blown to be limited. More details on the blowing means are given below. The length of the section of the table comprising the blowing means is indicated $L_i$ in FIG. 1. This section of the transport system is also called the impulse section in this description.

The air flow from the blowing means lifts and carries the web along the table. In order to prevent accumulation of air under the web, and to ensure that the film does not lift off the table, the invention provides sucking means downstream of blowing means; downstream in this description means that the sucking means are located after the blowing means in the web transport direction, or in the air flow direction; in the embodiment of FIG. 1, the sucking means comprise openings or slots 6*a*–6*c*; these sucking means are connected to vacuum box or cabinet 7, located under the sucking means; the vacuum in the vacuum box 7 is preferably comprised in a range of 10 to 500 Pa. For sucking air from the vacuum box, one may use any type of air extraction device, such as fans, pumps or the like, that are not represented on the drawing. Thus, at least part of the air blown from the blowing means is sucked into the sucking means; this ensures that the thickness of the air film under the web remains substantially constant along the transport table. More details on the sucking means are given below. The length of the section of the table comprising the sucking means is indicated $L_v$ in FIG. 1. This section is called the sucking section.

According to the invention, in order to avoid that the web is sucked to the table under the sucking action of the blowing means, there is provided elongated humps 8 protruding from the surface of the table, downstream of the sucking means; the humps extend transverse to the web transport direction; these humps ensure that a sucking space is formed between the table and the web, upstream of the humps: thus, the sucking means may suck the air in excess, without any risk of sucking the web onto the table. The humps also ensure a proper tension of the web, and a damping of the web tensions, so that the transport system may absorb variations of the web tension, and small differences of web input and output rates. More details on the shape and dimensions of the humps are discussed below. The length of the section of the table comprising the humps is indicated $L_h$ in FIG. 1, and the height by which the humps protrude above the table is indicated h on FIG. 1.

The total length $L_h+L_i+L_v$ of the transport system of FIG. 1 is noted $L_T$. Preferably, in a transport system according to the invention, one or several of the following conditions are met.

$$0.70 L_T \leqq L_i \leqq 0.85 L_T \quad (1)$$

$$0.05 L_T \leqq L_v \leqq 0.10 L_T \quad (2)$$

$$0.10 L_T \leqq L_h \leqq 0.20 L_T \quad (3)$$

$$h \leqq L_h \quad (4)$$

These conditions on the length of each section in the case of a rectangular table of the type of FIG. 1 are actually equivalent to conditions on the surfaces of the respective sections of the table. The first condition ensures that the impulse section of the transport system is long enough to ensure a proper web transport and a correct web tension. The second condition simply ensures that the sucking section is long enough to allow sucking of the air. The length of the hump section is determined to ensure smooth transport and smooth running of the Coanda system. Its length is as small as possible, bearing in mind that it should preferably be high enough to lift the web and provide sufficient sucking space and a lifting force sufficient to overcome the sucking force of the sucking means.

In the embodiment of FIG. 1, the overall length of the section of the table comprising the blowing means is 0.515 m; the length of the section of the table comprising the sucking means is 40 mm and the length of the section of the table comprising the hump is 80 mm; thus, the ratio between the area of the table comprising the blowing means and the total area of the table including the hump is around 81%, and is comprised in the preferred range of 70 to 85%. The ratio between the area of the table comprising the sucking means and the total area of the table is around 6%, and is comprised in the preferred range of 5 to 10%. The ratio between the area of the table comprising the sucking means and the total area of the table is around 12%, and is comprised in the preferred range of 10 to 20%.

The blowing means are now discussed in detail. In the embodiment of FIG. 1, they comprise a series of holes, nozzles, openings or slots that are distributed over the whole surface of the impulse section of the transport system. They are preferably equally distributed over the surface of the impulse section of the transport system, so as to ensure a regular tensioning and pulling of the web across its width. See FIG. 3 and its description below.

Such a distribution of the blowing means ensures a transport force higher than the existing Coanda systems where a single flow of air is blown parallel to the table; in such systems, the speed of the air is twice as much as the speed of the web, and has a pressure around 1000 Pa. This causes high amounts of air to be blown, with a very high noise. The invention is also more efficient than existing blowing systems with wide openings.

Preferred range for the angle between the direction of the blowing means and the direction normal to the table is 10 to 90°; in the embodiment of FIG. 1, the blowing means are comprised of holes, the longitudinal direction of which forms an angle of substantially 30° with the direction of the table surface. A range of 20–40° is preferred for the angle between the table and the opening. FIG. 2 shows a view at a higher scale of one hole 4*c*, with the surrounding table and the web. As shown on this figure, there is formed a secondary flow downstream of the opening 4*c*; this flow creates locally an volume 9 with a lower pressure; the air is accelerated downstream of the lower pressure volume, see reference 10. The impulse is transmitted to the web by the deviation of the air flow on the web, while the web is sucked to the table by the local depression created by the secondary flow.

The ratio between the area of the blowing means and the area of the impulse section of the transport system is preferably less than 0.5 or 1%. A value of 0.13% has proved appropriate, with circular openings having a diameter of 1 mm. Too high a value leads to lower efficiency of the table. Too low a value leads to high speed of the air blown, which may be detrimental to the web. The speed of the air is preferably at least 8 times the contemplated speed of the web, more preferably 10 to 15 times the speed of the web. Pressure is around 0.50 bar (50,000 Pa); however pressure may be chosen freely according to the mechanical resistance of the transport system, and the acoustic conditions.

The size and distribution of the openings, as well as the pressure, may be adapted to the needs. For instance, for thin webs, the number of openings may increase to reduce the spacing between the openings, while the size of the opening decreases.

This makes the system of the invention more efficient than the prior art system with a plurality of holes. The noise generated in the system of the invention is lower, and the amount of air is more limited. Accordingly, the force on the web in the transport system according to the invention is higher and more regularly distributed.

The sucking means, in the embodiment of FIG. 1, are comprised of series of holes, as can be seen on FIG. 3; these holes have a size of 5 mm diameter. The flow to the blowing means and from the sucking means is selected so that the ratio of the amount of air sucked to the amount of air blown is comprised between 0.5 and 1, and preferably around 0.7. These amounts ensure a good transporting force, while avoiding any contact of the web and the transport table.

The humps for the transport system are now described. In the preferred embodiment of FIG. 1, the cross section of the hump is circular, and has a diameter of 150 mm. It protrudes above the table, and its height above the table is around 20 mm. As explained above, the hump creates, upstream. of the hump, an air blocking section; in this section, the web is lifted away from the surface of the table, so that accumulated air may be sucked without sucking the web too. Indeed, the air stream impeding on the hump is partially blocked and accumulates upstream of the hump, thereby forming an air accumulation room, from which air may be sucked. Downstream of the hump, air is again accelerated, and the accelerated flow of air pulls the web.

In addition to forming this air accumulation section, the hump create a tension in the web; indeed, the acceleration of the air downstream of the hump pulls the web and creates a tension.

Last, the humps also act as damping means for the transport system; the air accumulation in front of the hump and the extended path of the web above the hump make it possible to absorb web tension, such as sudden increase of the web tension created by jerking of the cutting unit or transport unit following the transport system of the invention.

The cross section of the hump is not limited to the example of FIG. 1; it should be understood that the diameter of the hump, in case it is circular, could vary, and is not limited to this value: a preferred range for the diameter of the section of the hump, in case it is circular, is from 0.05 to 0.5 m. The diameter of the hump section is preferably at least eight times the thickness of the contemplated air layer which is created without air sucking and without a web. The cross section of the hump may also have a shape different from a circle, and could for instance be an arc of ellipse, an arc of parabola, or the like.

Ideally, the hump would have an aerodynamic profile similar to the upper part of the wing of an airplane, so as to lift the web upstream of the hump, create an air accumulation volume, and accelerate the air flow downstream of the web. Practically, the shape of the hump is chosen so as to achieve blocking of the air upstream, without stopping the transport of web, even if only pieces of web are transported. Upstream of the hump, the angle between the transport system and the tangent to the hump is preferably comprised between 30° and 150°, so as to ensure air blocking.

The shape of the hump is preferably chosen so as to allow the web to pass over the web without any problem. The shape of the hump is preferably rounded to avoid any air turbulence in the air layer between the table and the web. The hump protrude above the table, and the height of the hump, that is the distance between the plane of the table and the top of the humps is preferably around half the radius of the cross section of the hump, where this cross section is circular; in the embodiment of FIG. 1, the height of the humps is around 20 mm. The height of the hump may ensure that the humps have some effect on the web, and allow the sucking of air into the sucking means; the height should preferably be low enough to ensure that the web will be able to pass over the humps; too high a value may cause the web to be blocked in front of the humps. The humps ensure that there is always a sufficient distance between the web and the sucking means of the table, so that air may be sucked without any risk of sucking also the web. This distance is roughly two third of the height of the hump, in the embodiment of FIG. 1, for the value of sucking depression given above.

FIG. 3 is a top view of the transport. system of FIG. 1; the elements already described in reference to FIG. 1 are not described again; as shown on FIG. 3, the blowing means comprise series of holes in the table surface; more specifically, the blowing means comprise 12 lines of 17 holes or nozzles, each line being offset with respect to the adjacent ones; the diameter of each of the holes is around 1 mm. The sucking means comprise three lines of holes, each line being offset with respect to the adjacent one; the diameter of each of the holes is around 5 mm. The table of FIG. 3 is intended to be used for the transport of a web in the direction represented by arrow 10 on FIG. 3; this direction is the longitudinal direction of the table.

In the embodiment of FIG. 3, the area covered by the sucking means represents around 50% of the area of the hump. The position of the sucking means and their size are chosen so that they suck air upstream of the hump, where the hump ensure that the web is raised away from the table. The table of FIG. 3 is also adapted to be assembled with another table. It thus comprises a number of holes for screwing or assembling the table onto a support. Furthermore, the hump is also extending below the table, so that it covers part of an adjacent table; this explains why the section of the table on the left handside of FIG. 3 does not comprise any blowing means or openings: this section would indeed be covered by the hump of the adjacent table.

FIG. 4 is a top view of a transport system according to the invention; the transport system of FIG. 4 comprises two series of tables similar to the one of FIGS. 1 and 3; each series of tables is intended to transport one longitudinal edge of a web 15 to be transported in the direction of arrow 17. The series of tables for the left edge 19 of the web is comprised of 10 tables similar to the ones of FIGS. 3, that is of five rows of two tables. Similarly, the series of tables for the right edge 21 of the web is comprised of 5 rows of 2 tables. The two rows of tables are spaced apart, so that only the edges of the web 15 are maintained or supported by the tables; the middle part of the web is not supported. At the end of the transport system, that is downstream of the last row of tables of each series is provided a rounded hump 23 extending from one series of tables to the other one, along the whole width of the web. The web may be taken from this hump for further processing, e.g. in a winding apparatus or in any other devices.

Preferably, the blowing means of the tables of the transport system of FIG. 4 are blowing air in a direction slightly diverging from the transport direction 17, so as to stretch or flatten the web in the transverse direction. FIG. 4 shows the projection in a horizontal plane of the blowing direction of one table of each series. As depicted oil FIG. 4, the blowing direction forms an angle with the transport direction 17, so that the transport system imparts a pulling force of 10 N/m to the web, in the transverse direction. Preferably, the angle between the blowing direction and the transport direction in the plane of the tables (the horizontal plane in the arrangement of FIG. 4) is between 5 and 30°.

In a preferred embodiment, the series of tables of the transport system of FIG. 4 are adapted to move transverse to the transport direction; this allows to simply adapt the transport system to different sizes of webs. One way to obtain this feature is to provide air displacement means and vacuum means with flexible hoses that allow the tables to be moved; this is schematically depicted on FIG. 4, where the air pressure conduits 25 for the right edge series of tables is provided with a series of outputs for providing air to the tables of each row. The air pressure conduit for the tables on the other edge, and the vacuum conduit for the tables of both edges are not represented on FIG. 4; they may have a structure similar to the one of the air pressure conduit 25.

FIG. 5 is a top view of another transport system according to the invention; the transport system of FIG. 5 shows an arrangement for folding or retracting a web, so that it can be brought, e. g. to a device such as a knife or a chopper. The transport system of FIG. 5 is comprised of 24 tables similar to the one described in reference to FIGS. 1 and 2. The tables are arranged in five row; the first two rows 27 and 29 in the transport direction 31 each comprise 6 tables; the third row 33, fourth row 35 and fifth row 37 respectively comprise 5, 4 and 3 tables. On each table, an arrow indicates the blowing direction, in the plane of the table; as can be seen from FIG. 5, in the first two rows of tables, the blowing direction of the two central tables is parallel to the transport direction; the blowing direction of the two tables on each edge is slightly diverging, as explained for the transport system of FIG. 4, so that the web is stretched in the transverse direction. In the third row, the blowing direction of the central table is parallel to the transport direction; the blowing direction of the two tables on each edge is slightly converging, so that the web is fully maintained on the transport system, although it is clearly not stretched any more. In the fourth row, the blowing direction of the two tables on each side is again converging; in the fifth row, the blowing direction of the central table is parallel to the transport direction, and the blowing direction of each of the side table on each side is again converging. This ensures that the web is picked up and is transported on a reduced width at the output of the transport system of FIG. 5. As in FIG. 4, FIG. 5 depicts an air pressure conduit 39 for all the tables, with outputs 41–45 associated with each row of tables.

The invention thus allows transport of a web, together with a precise control of the width of the web. As described in reference to FIG. 4, it is possible to control the transverse stretch of the web to ensure that the web is kept properly stretched. As described in reference to FIG. 5, it is possible to pack the web on a reduced width to allow for further processing. It should also be noted that the transport system of the invention may be used for pieces of web, and not necessarily for entire web; for instance, the transport system of FIG. 5 could be used for transporting parts of the web that are to be destroyed, such as the edges cut from the web at the exit of the oven. In such a case, FIG. 6 shows a cross section of a possible arrangement of the transport systems of FIGS. 4 and 5. The transport system of FIG. 6 is intended to be used at the exit of an oven. It comprises a horizontal transport system 47, of the type of the one of FIG. 4; this table is taking the web at the exit of the oven and is transporting it to a standard Coanda effect device 49, located downstream of the horizontal table. The web coming out of the Coanda system may be directed to the winding apparatus, as schematically represented by the arrow 51, or may be directed to a vertical transport system 53, of the type represented on FIG. 5. The beginning of the vertical transport system is at the output of the Coanda effect device 49. This transport system is bringing the web or the web edges to a knife or chopping device 55 located at its end.

The transport system according to the invention may be used for a variety of purposes; it may easily be adapted to different uses by simply selecting and assembling various types and numbers of tables. The exemplified embodiment described in reference to the figures are only indicative of the various possible uses of transport system of the invention.

The invention provides a web transport systems applying forces of up to 15 N/m web width. Due to the arrangement of the blowing means, these forces can be applied even to ultra thin webs, without risk of destroying them. The invention permits transport of webs over long distances, such as 20 to 30 meters, without increase of the amount of air below the web over the running length; the invention uses low air volumes, and part of the air sucked from the sucking means may be fed to the blowing means.

As explained in relation to FIGS. 4 and 5, the transport system of the invention may accommodate various widths of web, different web thickness in the range from submicron webs to 36 $\mu$m webs or even thicker webs. The invention may also be used for materials other than plastic webs, for instance aluminium foil.

What is claimed is:

1. A table element for transporting a web, said table element having a substantially flat surface at least one protruding hump protruding from said substantially flat surface, at least one inclined blowing means in the substantially flat surface, at least one sucking means in said substantially flat surface, said at least one sucking means being located between said blowing means and said protruding hump.

2. A table element according to claim 1, wherein said protruding hump ensures that a web is lifted away from the substantially flat surface of said table element upstream of the protruding hump.

3. A table element according to claim 2, wherein the sucking means are located upstream of the hump, in a section of said substantially flat surface where said protruding hump ensures that a web is lifted away from the substantially flat surface of said table element.

4. A table element according to claim 2, wherein the rounded hump has a circular cross section with a diameter at least eight times the thickness of the air layer between the table and the web to be transported.

5. A table element according to claim 1, wherein the shape of the protruding hump ensures a partial blocking of the air blown by the blowing means, upstream of the hump.

6. A table element according to claim 1, wherein the shape of the protruding hump ensures acceleration of the air flowing over the hump, downstream of the hump.

7. A table element according to claim 1, wherein said blowing means comprise lines of offset holes.

8. A table element according to claim 1, wherein said sucking means comprise lines of offset holes.

9. A table element according to claim 1, wherein the projection on said table of a blowing direction of said blowing means forms an angle with the transport direction.

10. A table element according to claim 1, wherein the at least one protruding hump is a rounded hump.

11. A table element according to claim 1, wherein the angle between a blowing direction of said blowing means and a direction perpendicular to the table element is between 10° and 90°.

12. A table element according to claim 1, wherein the angle between a blowing direction of said blowing means and a direction perpendicular to the table element is around 30°.

13. A table element according to claim 1, wherein the speed of the air blown by said at least one blowing means is at least 8 times a speed of the web.

14. A table element according to claim 1, wherein the speed of the air blown by said at least one blowing means is 10 to 15 times a speed of the web.

15. A table element according to claim 1, wherein the ratio of an area of said substantially flat surface comprising the said at least one blowing means to an area of said substantially flat surface is less than 1%.

16. A table element according to claim 1, wherein the ratio of an area of said substantially flat surface comprising the said at least one blowing means to an area of said substantially flat surface is less than 0.5%.

17. A transport system comprising at least two table elements each table element having:

a substantially flat surface at least one protruding hump protruding from said substantially flat surface, at least one inclined blowing means in the substantially flat surface, at least one sucking means in said substantially flat surface, said at least one sucking means being located between said blowing means and said protruding hump.

18. The transport system according to claim 17, wherein a first of said at least two table elements and a second of said at least two table elements are spaced apart in a direction transverse to the web transport direction.

19. The transport system according to claim 18, wherein said first and second table elements are adapted to be moved one toward or away from the other.

20. The transport system according to claim 17, wherein said at least one inclined blowing means of a table element on a side of the transport system have a blowing direction directed towards said side of the transport system.

21. The transport system according to claim 17, further comprising means for pumping air to said at least one blowing means, and from said at least one sucking means, wherein the ratio between the the flow of air pumped from the sucking means and the flow of air pumped to the blowing means is between 0.5 and 1.

22. The transport system according to claim 21, wherein said ratio is 0.7.

23. A process for transporting webs on the surface of a table having a substantially flat surface and at least one rounded hump protruding from said substantially flat surface, comprising the steps of (a) blowing air through said substantially flat surface, upstream of said at least one hump;

(b) sucking air through said substantially flat surface, immediately upstream of the rounded hump.

24. The process according to claim 23, wherein the step of blowing air comprises blowing air in a direction inclined with respect to the substantially flat surface of the table.

* * * * *